US008184999B2

(12) United States Patent
Kyung

(10) Patent No.: US 8,184,999 B2
(45) Date of Patent: May 22, 2012

(54) IMAGE FORMING APPARATUS AND CONTROL METHOD THEREOF

(75) Inventor: Kyu Chul Kyung, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 451 days.

(21) Appl. No.: 12/550,522

(22) Filed: Aug. 31, 2009

(65) Prior Publication Data

US 2010/0074644 A1 Mar. 25, 2010

(30) Foreign Application Priority Data

Sep. 19, 2008 (KR) ..... 10-2008-0091878

(51) Int. Cl.
*G03G 21/12* (2006.01)

(52) U.S. Cl. ..... 399/35; 399/120

(58) Field of Classification Search ..... 399/12, 399/13, 24, 25, 27, 28, 30, 107, 119, 120; 250/200, 205

See application file for complete search history.

(56) References Cited

U.S. PATENT DOCUMENTS 5,530,521 A 6/1996 Lee

FOREIGN PATENT DOCUMENTS

KR 1996-10477 1/1999

*Primary Examiner* — David Gray
*Assistant Examiner* — Barnabas Fekete
(74) *Attorney, Agent, or Firm* — Staas & Halsey LLP

(57) ABSTRACT

An image forming apparatus and a control method thereof, the control method including applying a minimum current to a light emitting element, and applying one or more higher currents, up to a maximum current, to the light emitting element, if a light receiving element fails to detect light emitted by the light emitting element.

20 Claims, 9 Drawing Sheets

IMAGE FORMING APPARATUS AND CONTROL METHOD THEREOF

CROSS-REFERENCE TO RELATED APPLICATIONS

This application claims the benefit of Korean Patent Application No. 10-2008-0091878, filed on Sep. 19, 2008 in the Korean Intellectual Property Office, the disclosure of which is incorporated herein, by reference.

BACKGROUND OF THE INVENTION

1. Field of the Invention

Aspects of the present invention relate to an image forming apparatus and a control method thereof.

2. Description of the Related Art

One example of an image forming apparatus is an electrophotographic image forming apparatus, wherein a photoconductor that is charged by a charge device is exposed to light emitted from a Laser Scanning Unit (LSU), according to a print signal, such that an electrostatic latent image is formed on the surface of the photoconductor. The electrostatic latent image is developed by a developer fed from a developing device, to form an image, and then the image is transferred to paper, using a transfer device, completing a desired image.

In the above-described image forming apparatus, the developer is composed of a powdered toner and a liquid-phase carrier. The toner is attached to the electrostatic latent image, to change the electrostatic latent image into a toner image. Some of the toner attached to the electrostatic latent image is not transferred from the photoconductor to the transfer device, or from the transfer device to the paper, and instead remains on the photoconductor or the transfer device.

The toner residue on the photoconductor and transfer device is removed by a cleaning device and is stored in a waste toner container, via the operation of a waste toner collecting device. Meanwhile, the liquid-phase carrier is recovered by a carrier collecting device.

In a color developing device yellow, cyan, magenta, and black toners are generally used. This kind of color developing device generates a greater amount of waste toner than a developing device using only one toner. Accordingly, it is necessary to sense whether the waste toner container is full of waste toner, in order to know an exchange time of the waste toner container.

Conventionally, a waste toner sensing device is provided in the image forming apparatus, which includes a light emitting element to emit light and a light receiving element to receive the light emitted from the light emitting element, which are arranged on opposing sides of the waste toner container. The light emitting element includes a light emitting diode, and the light receiving element includes a semiconductor switch device. If the light emitted from the light emitting element collides with the waste toner in the waste toner container, the light receiving element will fail to receive the light. In this way, sensing the presence of waste toner is possible, by determining how much of the light is absorbed/blocked by the waste toner. In this case, it will be appreciated that the smaller the quantity of light received by the light receiving element, the greater the amount of waste toner in the waste toner.

Conventionally, a maximum current allowed by the light emitting diode is applied to the light emitting element, to allow the light emitting element to emit a maximum quantity of light. This is to enable the light to pass through the waste toner container, even when an inner surface of the waste toner container is contaminated. However, applying the maximum current to the light emitting element may shorten the lifespan of the light emitting element and the waste toner sensing device, and may waste of energy.

SUMMARY OF THE INVENTION

It is an aspect of the present invention to provide an image forming apparatus and a control method thereof, wherein the magnitude of a current applied to a waste toner sensing device can be regulated, within a range having no negative effect on the sensing performance of the waste toner sensing device, resulting in an extended lifespan of the waste toner sensing device and reduced power consumption.

In accordance with one aspect of the present invention, there is provided a control method of an image forming apparatus, to sense the amount of toner received in a waste toner container, using a light emitting element and a light receiving element, the control method including: applying a first current to the light emitting element; and applying a higher second current to the light emitting element, if the light receiving element fails to receive the light emitted from the light emitting element.

In accordance with another aspect of the present invention, there is provided a control method of an image forming apparatus, including: applying a first current having a first value to a light emitting element used to emit light to a waste toner container; applying a second current having a second value that is higher than the first value to the light emitting element, if a light receiving element fails to receive the light emitted from the light emitting element; determining whether the light receiving element receives the light emitted from the light emitting element; and setting the first current value to the second current value, if the light receiving element fails to receive the light.

In accordance with a further aspect of the present invention, there is provided an image forming apparatus including: a light emitting element to emit light to a waste toner container; a light receiving element to receive the light that has passed through the waste toner container; and a controller to apply a first current to the light emitting element and to apply one or more higher currents to the light emitting element, if the light receiving element fails to receive the light.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the exemplary embodiments, taken in conjunction with the accompanying drawings, of which.

DETAILED DESCRIPTION OF THE EXEMPLARY EMBODIMENTS

Figure 1:
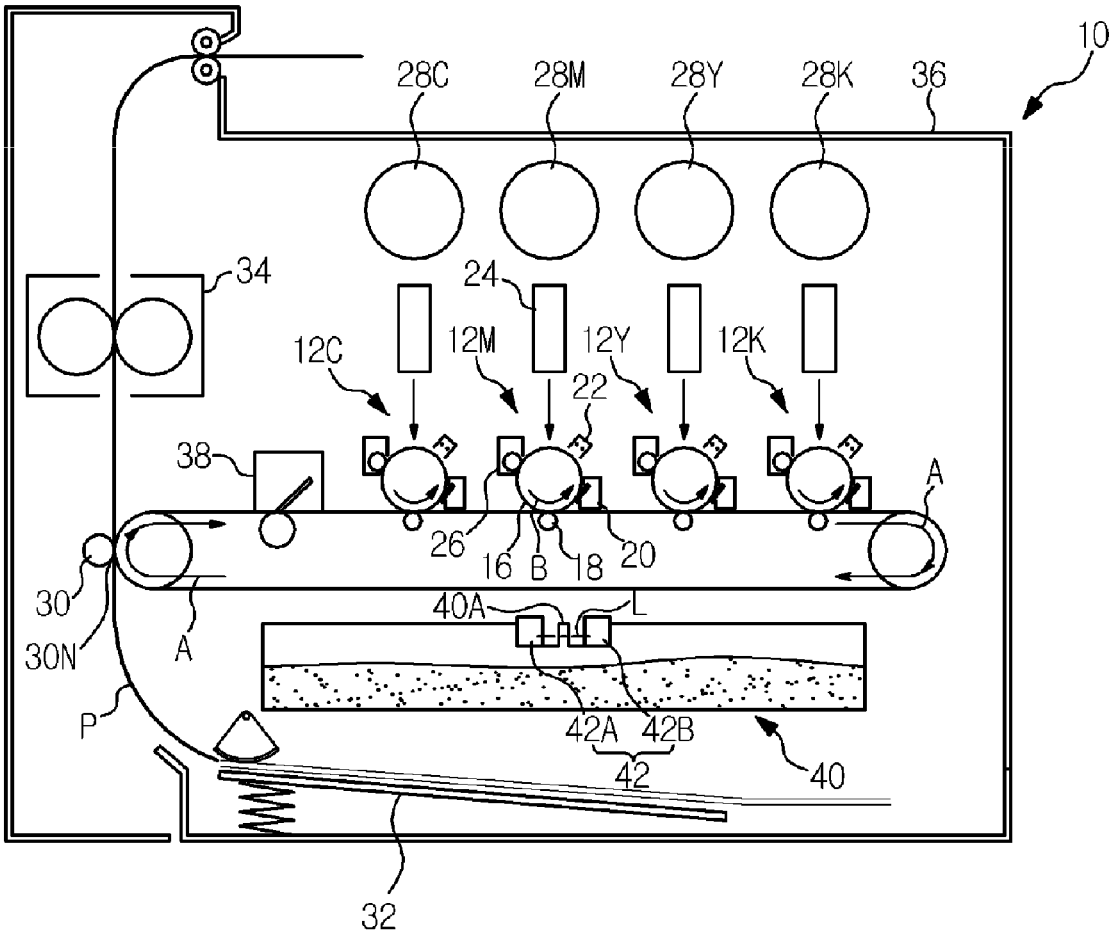
FIG. 1 is a view illustrating the schematic configuration of an image forming apparatus, according to an exemplary embodiment of the present invention.

Reference will now be made in detail to an image forming apparatus, according to an exemplary embodiment of the present invention, examples of which are illustrated in the accompanying drawings, wherein like reference numerals refer to like elements throughout. The exemplary embodiments are described below, in order to explain the aspects of the present invention, by referring to the figures.

Figure 2:
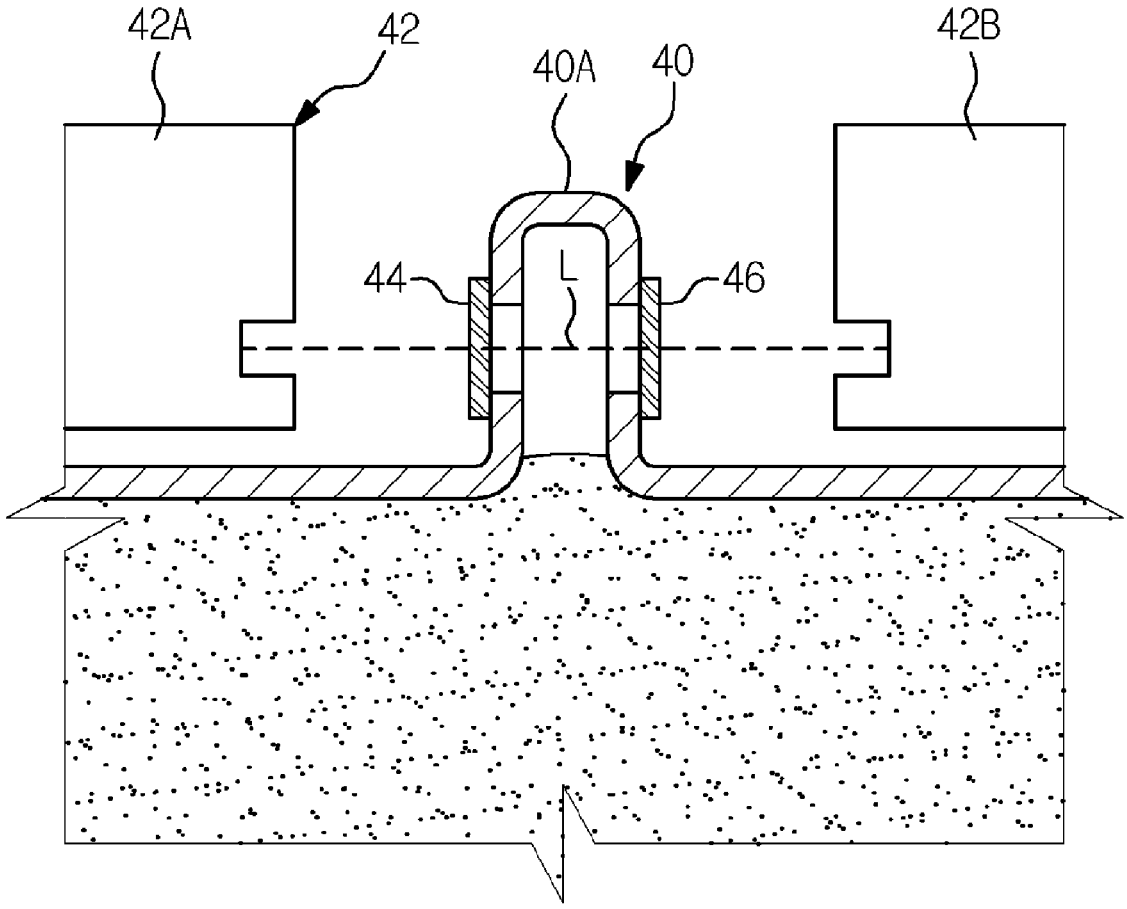
FIG. 2 is a sectional view illustrating a waste toner container and waste toner sensing device included in the image forming apparatus, according to the exemplary embodiment of the present invention.

FIG. 1 is a view illustrating the schematic configuration of an image forming apparatus, according to an exemplary embodiment of the present invention. FIG. 2 is a sectional view illustrating a waste toner container 40 and a waste toner sensing device included in the image forming apparatus.

As shown in FIG. 1, the image forming apparatus is a color printer that uses cyan C, magenta M, yellow Y, and black K toners to form images. The image forming apparatus includes print units 12C, 12M, 12Y and 12K, which serve to form C, M, Y, and K toner images, and which are arranged in parallel with respect to a rotating direction (designated by the arrow A in FIG. 1) of an intermediate transfer belt 14 that acts as an image carrier. The respective single-color toner images are sequentially transferred to, and overlapped on, the intermediate transfer belt 14. While described using four colors, it is understood that other numbers of colors, including only 1 color, could be used. Moreover, it is understood that the image forming apparatus can including scanning and/or facsimile units, as in a multifunctional device.

Each print unit 12C, 12M, 12Y and 12K includes a photoconductor 16, upon which a single-color toner image is formed. Around the photoconductor 16 are arranged a transfer roll 18, cleaning devices 20 and 38, a charge device 22, a light scanning device 24, and a developing device 26. The intermediate transfer belt 14 is nipped between the transfer roll 18 and photoconductor 16. The transfer roll 18, cleaning device 20, charge device 22, light scanning device 24, and developing device 26 are arranged in this sequence, with respect to a rotating direction (designated by the arrow B in FIG. 1) of the photoconductor 16. In addition, toner containers 28C, 28M, 28Y and 28K are arranged above the respective print units 12C, 12M, 12Y and 12K. Each toner container 28 and each developing device 26 are connected with each other, via a toner conveyance unit. Different colored toners are fed from each toner container 28C, 28M, 28Y and 28K to each developing device 26.

During the operation of the print unit 12C, 12M, 12Y and 12K, first, the photoconductor 16 is charged by the charge device 22, and then, a charged surface of the photoconductor 16 is linearly exposed to light from the light scanning device 24. An electrostatic latent image formed on the photoconductor 16 is developed into a toner image. The toner image is transferred to the intermediate transfer belt 14, which is nipped between the transfer roll 18 and the photoconductor 16. This print operation is sequentially performed by the respective print units 12C, 12M, 12Y and 12K, and the respective toner images are overlapped on the intermediate transfer belt 14, resulting in the formation of a full color toner image.

A transfer roll 30 is provided, which contacts the intermediate transfer belt 14 at a transfer nip 30N. The transfer roll 30 serves to transfer the full color toner image to a paper P, which is directed from a paper feed cassette 32 to the transfer nip 30.

A fixing device 34 is disposed above the transfer nip 30N. The paper P is directed to the fixing device 34, where the toner image is fixed onto the paper P. Then, the paper P is discharged to a tray 36 disposed on an upper surface of the image forming apparatus. Herein, the paper P refers to any printable media. In addition, the relative positions of the tray 36 and the paper feed cassette 32 can be varied.

When the toner image is transferred from the photoconductor 16 to the intermediate transfer belt 14, or from the intermediate transfer belt 14 to the paper P, some of the toner remains on the photoconductor 16 and/or the intermediate transfer belt 14, rather than being transferred to the intermediate transfer belt 14 and/or the paper P. This toner residue (waste toner hereinafter) is collected from the photoconductor 16 and intermediate transfer belt 14, by the cleaning devices 20 and 38.

The cleaning devices 20 and 38 are connected to a toner collecting device (not shown), which is connected to a waste toner container 40 that is detachably mounted below the intermediate transfer belt 14. The waste toner is collected by the cleaning devices 20 and 38 and conveyed to the waste toner container 40.

When the waste toner container 40 is full of the waste toner, the waste toner container 40 should be exchanged. Accordingly, to sense whether the waste toner container 40 is full, a waste toner sensing device 42 is installed near the waste toner container 40. The waste toner sensing device 42 senses whether the waste toner received in the waste toner container 40 reaches a predetermined height, which indicates that the waste toner container 40 is full.

As shown in FIG. 2*a* protruding portion 40A is formed at the center of an upper surface of the waste toner container 40. Transparent windows 44 and 46 are provided at opposing sidewalls of the protruding portion 40A. The transparent windows 44 and 46 are made of the same material as the waste toner container 40, but need not be the same material. Moreover, it is understood that the windows 44 and 46 can be openings to allow the light to pass through the waste toner container 40, or the waste toner container 40 could be transparent, such that any part thereof could be considered a window.

The waste toner sensing device 42 includes a light emitting element 42A to emit light L, and a light receiving element 42B to receive the light L. The light emitting element 42A and light receiving element 42B are arranged opposite to each other, with the windows 44 and 46 interposed therebetween. The light L sequentially passes through the window 44, the interior of the protruding portion 40A, and the window 46, and is then detected by the light receiving element 42B. Accordingly, if the waste toner in the waste toner container 40 does not reach a passage height of the light L, the light receiving element 42B is able to receive the light L. On the other hand, if the waste toner in the waste toner container 40 exceeds the passage height of the light L, the light receiving element 42B fails to detect the light L.

Figure 3:
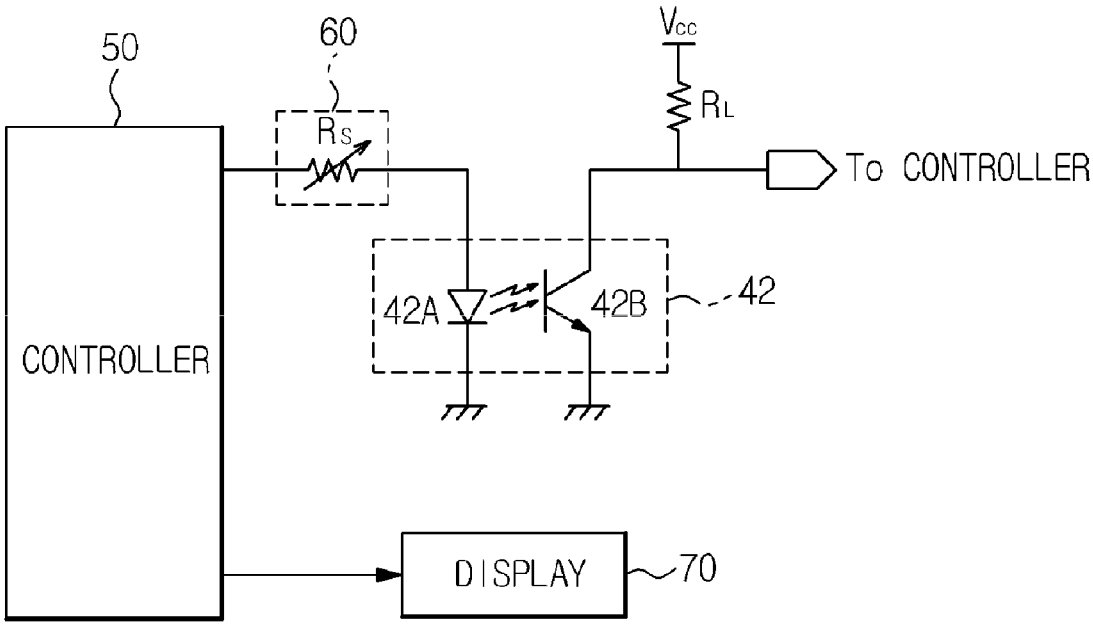
FIG. 3 is a schematic control block diagram of the image forming apparatus, according to the exemplary embodiment of the present invention.

FIG. 3 is a schematic control block diagram of the image forming apparatus, according to the exemplary embodiment of the present invention. As shown in FIG. 3, the image forming apparatus includes a controller 50 to control the general operations of the image forming apparatus. The controller 50 is connected to the waste toner sensing device 42, and a current regulator 60 that regulates the magnitude of a current applied to the waste toner sensing device 42. While note required, the controller 50 can be a processor.

The waste toner sensing device 42 includes the light emitting element 42A, which emits an amount of light L corresponding to a current applied thereto, to the waste toner container 40, and a light receiving element 42B to detect the light L emitted from the light emitting element 42A, which has passed through the waste toner container 40. The light emitting element 42A includes a light emitting diode, to emit different quantities of light, according to the magnitude of the current applied thereto. That is, the lower the magnitude of current, the smaller the quantity of light emitted by the light emitting diode, and the higher the magnitude of the current, the greater the quantity of light emitted by the light emitting diode.

The light receiving element 42B includes a semiconductor switch device, such as a transistor, etc. Accordingly, the waste toner sensing device 42 serves to transmit a signal, corresponding to the quantity of light having passed through the waste toner container 40, to the controller 50. In this case, if the waste toner fills the waste toner container 40 to a height that is less than a predetermined height, the light receiving element 42B is turned on by the light emitted from the light emitting element 42A and transmits an OV voltage signal to the controller 50. Otherwise, the quantity of light having passed through the waste toner container 40 is changed according to the amount of waste toner received in the waste toner container 40, and voltage signals corresponding to the quantity of light are transmitted to the controller 50.

The current regulator 60 serves to regulate the magnitude of current applied to the light emitting element 42A, according to a control signal of the controller 50. That is, a relatively low current value is applied, when it is desired to discharge a small quantity of light form the light emitting element 42A, whereas a relatively high current value is applied, when it is desired to discharge a large quantity of light.

The controller 50 is connected to a display 70. The controller 50 controls the display 70 to displays a "full waste toner container" message, when the waste toner container 40 is full of the waste toner, and to display a "contaminated waste toner container" message, when in that an inner surface of the waste toner container 40 is contaminated by the waste toner. For this, the controller 50 applies a drive current to the light emitting element 42A, via the current regulator 60. The drive current causes the light emitting diode to emit a minimum quantity of light, so as to extend the lifespan of the light emitting element 42A and to reduce power consumption. The display 70 can be integral to the image forming apparatus, or can be connected thereto. Moreover, the message can be otherwise conveyed, such as by using an audible signal, in addition to or instead of using the display 70.

In this case, if the light receiving element 42B detects the light emitted from the light emitting element 42A, when a minimum current is applied to the light emitting element 42A, it can be determined that the waste toner container 40 is not full of the waste toner. However, if the light receiving element 42B fails to detect the light emitted from the light emitting element 42A, when a minimum current is applied to the light emitting element 42A, the waste toner container 40 may be full, or the waste toner container 40 may not full, but the quantity of light is insufficient to pass through the contaminated inner surface of the waste toner container 40.

The waste toner collected in the waste toner container 40 is positively or negatively charged. Therefore, when the inner surface of the waste toner container 40 is oppositely charged, the waste toner will be electrostatically adhered to the inner surface of the waste toner container 40. However, when the waste toner is adhered to the windows 44 and 46, the waste toner will absorb the light L. As a result, even when the waste toner container 40 is not full, the waste toner container 40 may be erroneously determined as being full.

Therefore, if the light receiving element 42B fails to receive the light emitted from the light emitting element 42A, the controller 50 increases a value of the current applied to the light emitting element 42A, to determine whether the light detection failure is caused by the contaminated inner surface of the waste toner container 40, or by the waste toner container 40 actually being full. More particularly, the controller 50 applies a minimum current value to the light emitting element 42A and determines whether the light receiving element 42B detects the light. If the light receiving element 42B detects the light, the controller 50 interrupts the application of the current to the light emitting element 42A. On the other hand, if the light receiving element 42B fails to detect the light, the controller 50 may apply a higher current value to the light emitting element 42A.

After increasing the current applied to the light emitting element 42A, the controller 50 determines whether the light receiving element 42B detects the light. If the light receiving element 42B detects the light, the controller 50 determines that the waste toner container 40 is contaminated. On the other hand, if the light receiving element 42B fails to detect the light, the controller 50 determines that the waste toner container 40 is full.

Here, if the light receiving element 42B detects the light only after the higher current is applied, the controller 50 applies only the higher current, until the waste toner container 40 is replaced. Meanwhile, the controller 50 commands the display 70 to display a "contaminated waste toner container" alarm message, indicating that the waste toner container 40 is contaminated. If no light is received, the controller 50 commands the display 70 to display a "full waste toner container" alarm message.

Figure 4:
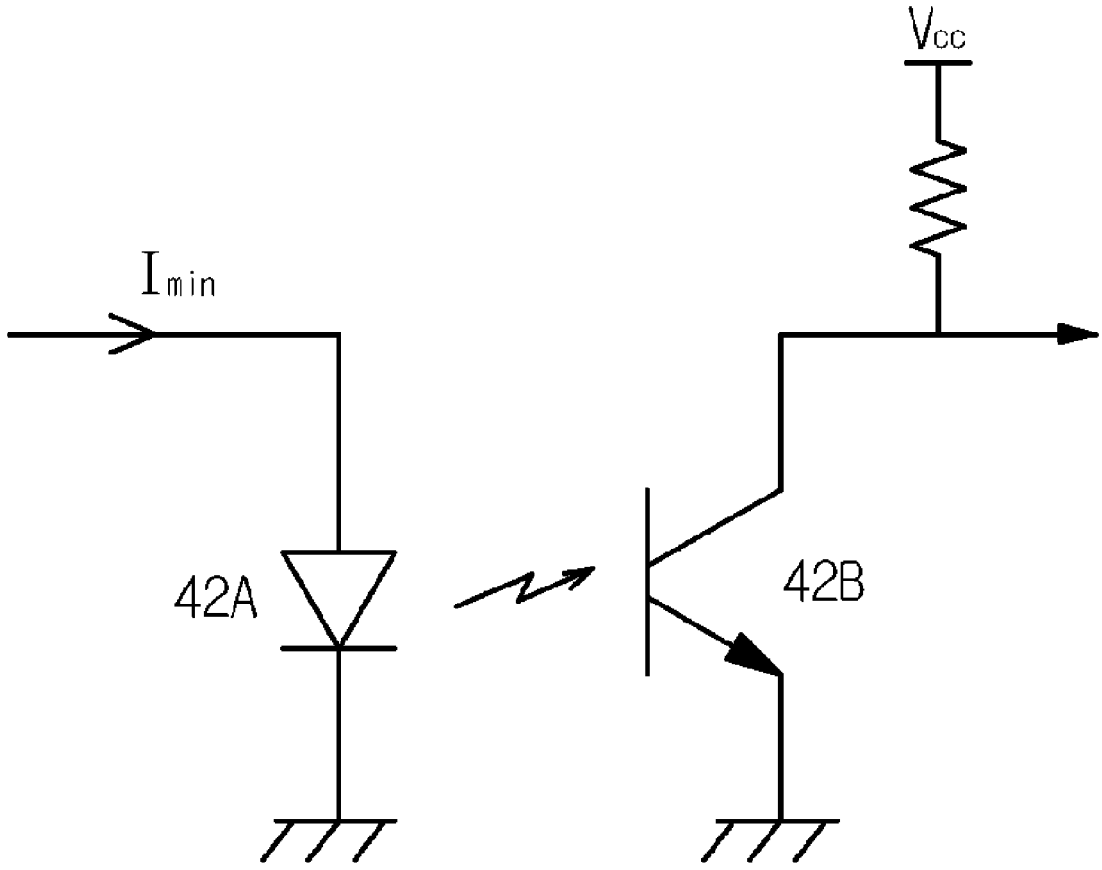
FIG. 4 is a view illustrating the quantity of light when a minimum current is applied to a light emitting element of the image forming apparatus, according to the exemplary embodiment of the present invention.
Figure 5:
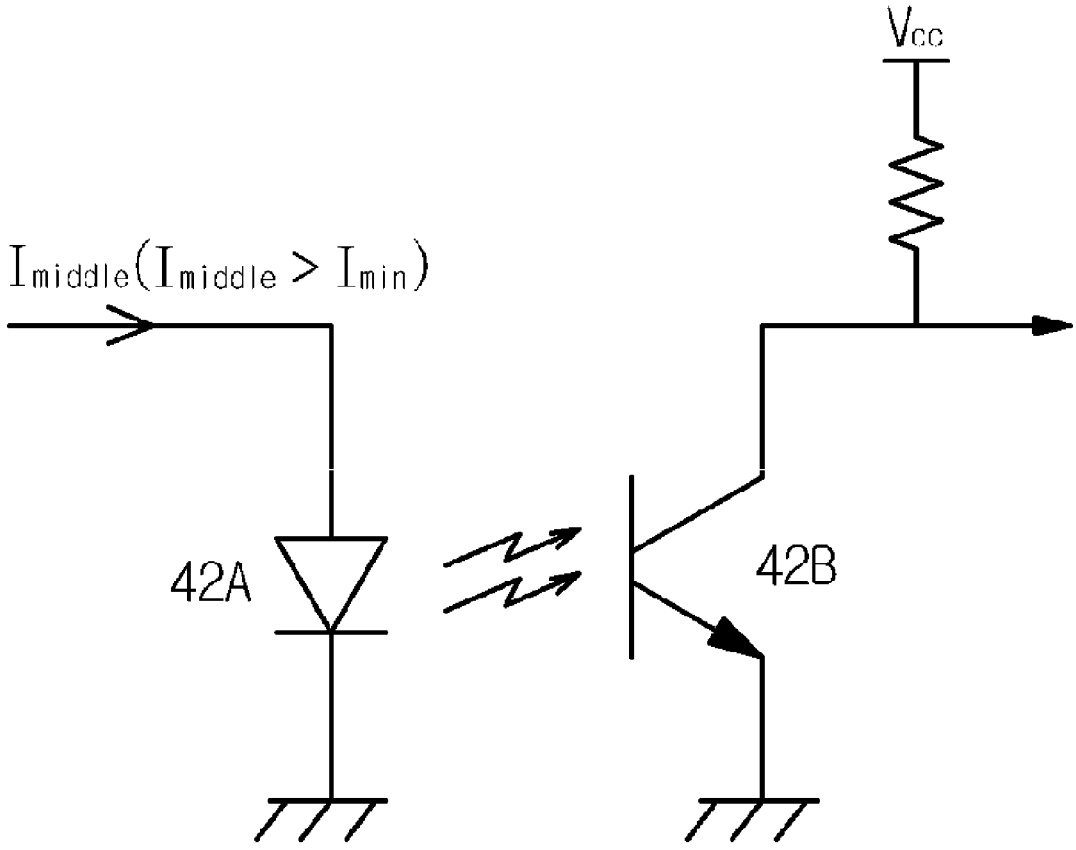
FIG. 5 is a view illustrating the quantity of light when a middle current is applied to the light emitting element, according to the exemplary embodiment of the present invention.
Figure 6:
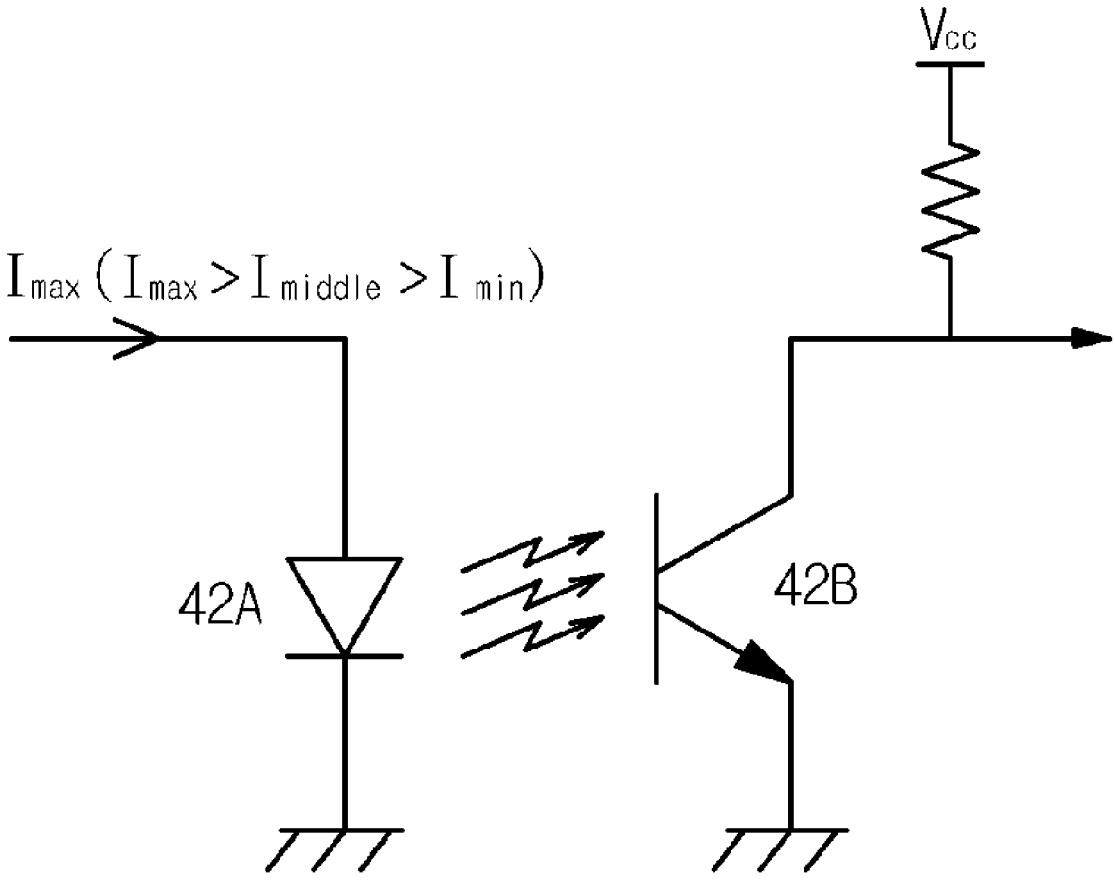
FIG. 6 is a view illustrating the quantity of light when a maximum current is applied to the light emitting element, according to the exemplary embodiment of the present invention.

FIGS. 4 to 6 illustrate the quantity of light when a minimum current $I_{min}$ having a minimum current value, a middle current $I_{middle}$ having a middle current value, and a maximum current $I_{max}$ having a maximum current value are applied, respectively, to the light emitting element 42A. As shown in FIGS. 4 to 6, the quantity of light is increased when the middle current $I_{middle}$ is applied to the light emitting element 42A, as compared to the case when the minimum current $I_{min}$ is applied to the light emitting element 42A. In addition, the quantity of light is increased when the maximum current $I_{max}$ is applied to the light emitting element 42A, as compared to the case when the middle current $I_{middle}$ is applied to the light emitting element 42A.

However, the higher current values applied to the light emitting element 42A may reduce the lifespan of the light emitting diode of the light emitting element 42A and unnecessarily consume power. Accordingly, in the present exemplary embodiment, the controller 50 initially applies the minimum current $I_{min}$ to the light emitting element 42A. Then, if the waste toner container 40 is full, or the inner surface of the waste toner container is contaminated, the controller 50 incrementally increases the current values to the middle current $I_{middle}$ and the maximum current $I_{max}$, so as to accurately determine the condition of the waste toner container 40. In this way, it is possible to extend the lifespan of and reduce the power consumption of, the waste toner sensing device 42, without negatively affecting the performance of the waste toner sensing device 42.

More specifically, when detecting whether the waste toner container 40 is full, the controller 50 initially applies the minimum current $I_{min}$, which is significantly lower in current value than the maximum current $I_{max}$. However, when the inner surface of the waste toner container 40 is contaminated, an insufficient quantity of light may cause the controller 50 to erroneously determine that the waste toner container 40 is full. Therefore, if the light receiving element 42B fails to detect light when the minimum current $I_{min}$ is applied to the light emitting element 42A, the middle current $I_{middle}$ is applied to the light emitting element 42A, so as to increase the quantity of light. If the light receiving element 42B detects the light, by virtue of the increased quantity of light, it can be determined that the inner wall of the waste toner container 40 is contaminated.

If the light receiving element 42B still fails to detect the light produced by the application of the middle current $I_{middle}$, the maximum current $I_{max}$, which is the maximum current applicable to the light emitting element 42A, may be applied, to maximize the quantity of light. If the light receiving element 42B then receives the light, it can be determined that the inner surface of the waste toner container 40 is contaminated. On the other hand, if the light receiving element 42B still fails to receive the light, it can be determined that the waste toner container 40 is actually full of the waste toner.

Figure 7:
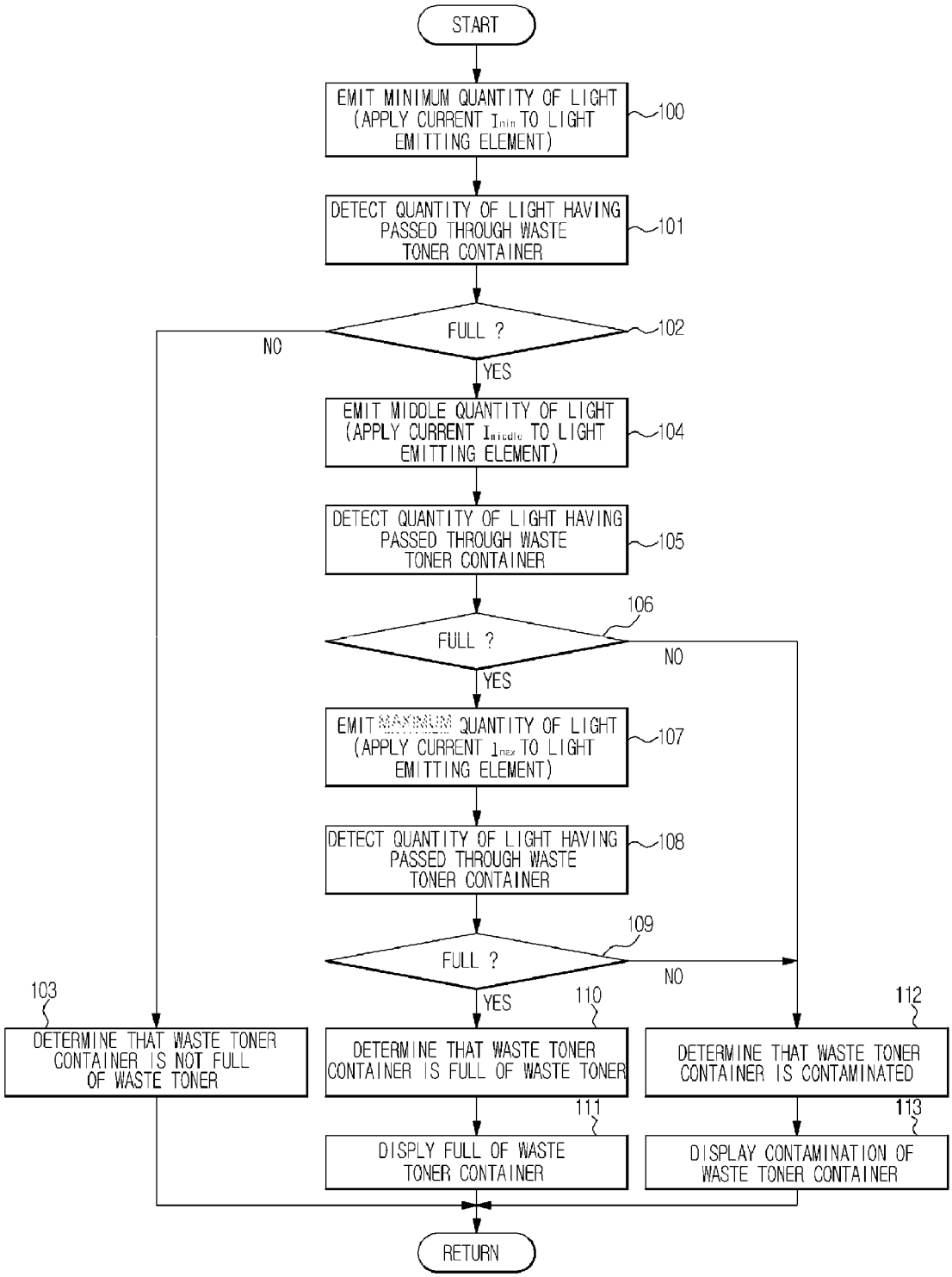
FIG. 7 is a flow chart illustrating a control method of the image forming apparatus, according to the exemplary embodiment of the present invention.

FIG. 7 is a flow chart illustrating a control method of the image forming apparatus, according to an exemplary embodiment of the present invention. Referring to FIG. 7, to determine whether the waste toner container 40 is full, the controller 50 first applies the minimum current $I_{min}$ to the light emitting element 42A, via the current regulator 60, to cause the light emitting element 42A to emit a minimum quantity of light (100).

The controller 50 then determines whether the light receiving element 42B detects the light (101). Then the controller 50 determines whether the waste toner container 40 is full of the waste toner (102). If the light receiving element 42B detects the light, it is determined that the waste toner container 40 is not full of the waste toner (103).

On the other hand, if the light receiving element 42B fails to detect the light, the controller 50 applies the middle current $I_{middle}$, to allow the light emitting element 42A to emit a middle quantity of light (104). The controller 50 determines whether the light receiving element 42B detects the light (105).

The controller 50 then makes another determination, as whether the waste toner container 40 is full of the waste toner (106). If the light receiving element 42B detects the light, it is determined that the inner surface of the waste toner container 40 is contaminated (112), and the display 70 displays the "contaminated waste toner container" alarm message. On the other hand, if the light receiving element 42B fails to detect the light, the controller 50 applies the maximum current $I_{max}$, to allow the light emitting element 42A to emit the maximum quantity of light (107).

The controller 50 then determines whether the light receiving element 42B detects the light (108). The controller 50 then makes another determination, as to whether the waste toner container 40 is full of the waste toner (109).

If the light receiving element 42B detects the light, it is determined that the inner wall of the waste toner container 40 is contaminated (112), and the display 70 displays the "contaminated waste toner container" alarm message (113). On the other hand, if the light receiving element 42B fails to detect the light, the controller 50 determines that the waste toner container 40 is actually full (110), and the display 70 displays the "full waste informs of the full condition of the waste toner container 40 (111).

Figure 8:
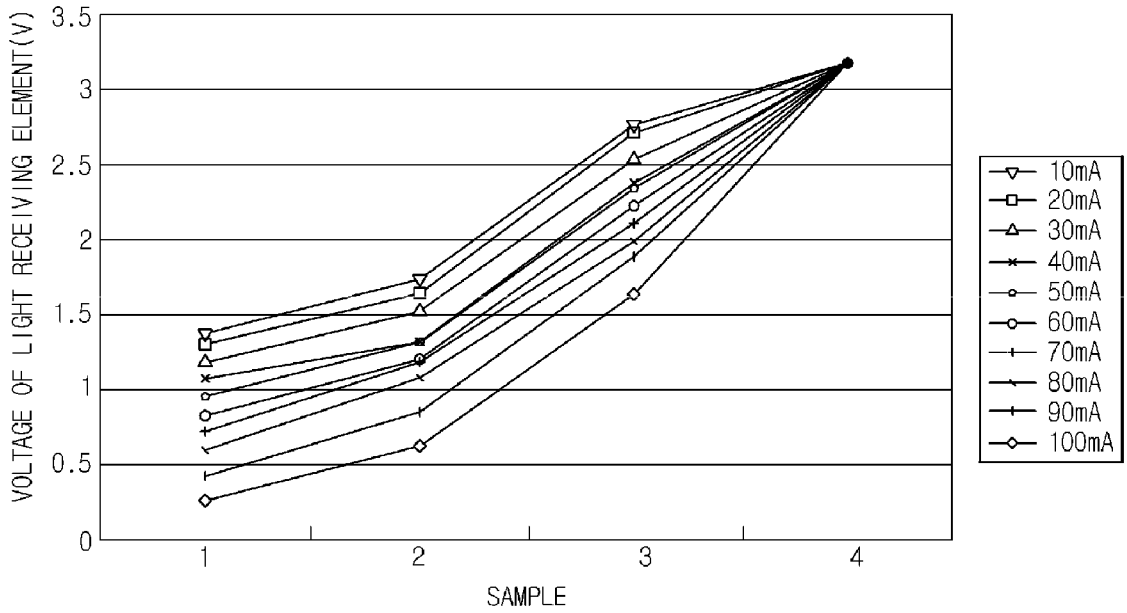
FIG. 8 is a graph illustrating a relationship between the magnitude of a current applied to the light emitting element and a voltage of the light receiving element, in the image forming apparatus according to the exemplary embodiment of the present invention.
Figure 9:
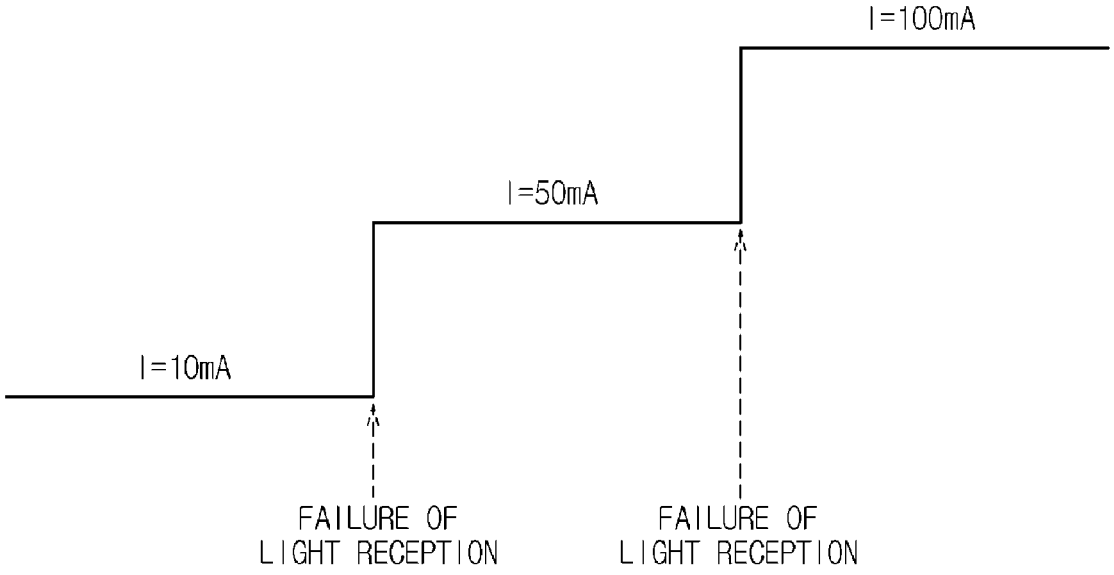
FIG. 9 is a view illustrating stepwise increase of current applied to the light emitting element of the image forming apparatus, according to the exemplary embodiment of the present invention.

FIG. 8 is a graph illustrating the relationship between the magnitude of the current (measured in milliamps) applied to the light emitting element 42A and the voltage of the light receiving element 42B. FIG. 9 is a view illustrating the stepwise increase of the current applied to the light emitting element 42A.

In FIG. 8, Sample 1 represents the case wherein the waste toner container 40 is empty, Sample 2 represents the case wherein the waste toner container 40 is slightly contaminated, Sample 3 represents the case wherein the waste toner container 40 is highly contaminated, and Sample 4 represents the case wherein the waste toner container 40 is full of waste toner. As shown in FIG. 8, assuming that the same magnitude of current is applied to the light emitting element 42A, it can be appreciated that the voltage of the light receiving element 42B gradually increases from Sample 1 to Sample 4. Usually, if the voltage of the light receiving element 42B is 3.1V, or more, it is determined that the waste toner container 40 is full of waste toner. Also, if the voltage at the light receiving 42B element is less than 3.1V, it is determined that the waste toner container 40 is not full of waste toner.

Specifically, in the case of Sample 1, the voltage of the light receiving element 42B is always less than 3.1V, even when the currents of between 100 mA and 10 mA are applied. Therefore, it is determined that the waste toner container 40 is not full of waste toner. However, it can be appreciated that applying the current of 10 mA to the light emitting element 42A can reduce power consumption, as compared to when the current of 100 mA is applied.

It is noted that, according to product type, it may be determined that the waste toner container 40 is full, even if the voltage of the light receiving element 42B is less than 3.1V, for example, if the voltage is 2.5V, or more. In this case, if the current of 10 mA is continuously applied to the light emitting element 42A, the waste toner container 40 may not be full of waste toner, even if the voltage of the light receiving element 42B is 2.5V, or more. That is, as shown in FIG. 8, the waste toner container 40 may be contaminated to a degree between the contamination of Sample 2 and Sample 3, or may be full of waste toner, as in Sample 4. Accordingly, although applying a relatively low magnitude of current to a light emitting element 42A is advantageous, in view of consumption of electric power, there is a risk that the waste toner container may erroneously be determined to be full.

To solve the above-described problem and/or other problems, as shown in FIG. 9, the present exemplary embodiment proposes one exemplary solution in that, after current of 10 mA is applied to the light emitting element 42A, the magnitude of current is increased stepwise to 50 mA and 100 mA, whenever the light receiving element 42B fails to receive the light. This allows for an accurate determination, as to whether the waste toner container 40 is full of waste toner, or is contaminated.

As is apparent from the above description, in a control method of an image forming apparatus, according to the exemplary embodiment of the present invention, the magnitude of current applied to a light emitting element can be regulated, in such a manner that, after a minimum current value is initially applied, the magnitude of current applied to the light emitting element is incrementally increased to a maximum current value, whenever a light receiving element fails to receive light emitted from the light emitting element. This has the effect of minimizing the current applied to a waste toner sensing device, without reducing the sensing performance of the waste toner sensing device, resulting in an extended lifespan of the waste toner sensing device and reduced power consumption. While not required, it is understood that aspects of the present invention can be implemented using software and/or firmware stored on a readable storage medium and implemented by one or more processors.

Although a few exemplary embodiments of the present invention have been shown and described, it would be appreciated by those skilled in the art that changes may be made in these exemplary embodiments, without departing from the principles and spirit of the invention, the scope of which is defined in the claims and their equivalents.

What is claimed is:

1. A control method of an image forming apparatus including a waste toner container, a light emitting element to emit light through the waste toner container, and a light receiving element to detect the light that has passed through the waste toner container, the control method comprising:

applying a first current having a first value to the light emitting element; and applying a second current having a second value that is higher than the first value, to the light emitting element, if the light receiving element fails to receive the light emitted from the light emitting element at the first value.

2. The method according to claim 1, wherein the first current causes the light emitting element to emit a minimum amount of light detectable by the light receiving element.

3. The method according to claim 1, wherein the first value is less than a maximum value that causes the light emitting element to emit a maximum amount of light emittable by the light emitting element.

4. The method according to claim 3, wherein the second current value is less than the maximum value and causes the light emitting element to emit less than the maximum amount of light.

5. The method according to claim 1, wherein the second current causes the light emitting element to emit a maximum amount of light emittable by the light emitting element.

6. The method according to claim 5, further comprising:

determining that the waste toner container is full of waste toner, if the light receiving element fails to detect the maximum amount of light, while the second current is applied, and determining that the inner surface of the waste toner container is contaminated, if the light receiving element detects the maximum amount of light.

7. The method according to claim 6, further comprising:

displaying a full waste toner container alarm message, if it is determined that the waste toner container is full of waste toner; and displaying a contaminated waste toner container alarm message, if it is determined that the inner surface of the waste toner container is contaminated.

8. The method according to claim 1, further comprising incrementally applying currents having higher values than the second current, to the light emitting element, whenever the light receiving element fails to detect light emitted from the light emitting element.

9. The method according to claim 1, further comprising applying no current to the light emitting element, after the light receiving element detects light emitted from the light emitting element.

10. A control method of an image forming apparatus comprising:

applying a first current having a first value to a light emitting element, to emit light into a waste toner container;

applying a second current having a second value that is higher than the first value, to the light emitting element, if a light receiving element fails to detect the light produced by the application of the first current; and applying only the second current to the light emitting element, until the waste toner container is replaced, if the light receiving element failed to detect the light produced by the application of the first current.

11. The method according to claim 10, wherein:

the first current causes the light emitting element to emit a minimum quantity of light detectable by the light receiving element; and the second current value cause the light emitting element to emit a maximum amount of light emittable by light emitting element.

12. The method according to claim 10, wherein the second value is less than a maximum value that causes the light emitting element to emit less than a maximum amount of light emittable by the light emitting element.

13. The method according to claim 10, further comprising:

determining that the waste toner container is contaminated, if the light receiving element detects the light produced by the application of the second current value; and determining that the waste toner container is full of waste toner, if the light receiving element fails to detect the light produced by the application of the second current value.

14. An image forming apparatus comprising:

a light emitting element to emit light into a waste toner container;

a light receiving element to detect light emitted from the light emitting unit, which passes through the waste toner container; and a controller to apply a first current having a first value, to the light emitting element and to apply a second current having a second value that is higher than the first value, to the light emitting element, if the light receiving element fails to detect light emitted from the light emitting element, in response to the application of the first current.

15. The apparatus according to claim 14, wherein first current cause the light emitting element to emit a minimum amount of light detectable by the light receiving element.

16. The apparatus according to claim 14, wherein the controller sequentially applies currents having incrementally higher current values, to the light emitting element, whenever the light receiving element fails to detect light emitted from the light emitting element.

17. The apparatus according to claim 16, further comprising a display to display:

a full waste toner container message, if the waste toner container is full of waste toner; and a contaminated waste toner container message, if inner surface of the waste toner container is contaminated, wherein the display operates according to control signals from the controller.

18. A control method of an image forming apparatus comprising:

emitting a first amount of light from a light emitting element, into a waste toner container; and emitting a second amount of light that is greater than the first amount of light, from the light emitting element, if a light receiving element fails to detect the first amount of light.

19. The method according to claim 18, wherein:

the first amount of light is a minimum amount of light detectable by the light receiving element; and the second amount of light is a maximum amount of light emittable by light emitting element.

20. The method according to claim 18, further comprising:

determining that the waste toner container is contaminated, if the light receiving element detects the second amount of light; and determining that the waste toner container is full of waste toner, if the light receiving element fails to detect the second amount of light.

* * * * *